US009359990B2

(12) United States Patent
Ikeda

(10) Patent No.: US 9,359,990 B2
(45) Date of Patent: Jun. 7, 2016

(54) PLASMA GENERATING DEVICE AND INTERNAL COMBUSTION ENGINE

(71) Applicant: IMAGINEERING, INC., Kobe-shi, Hyogo (JP)

(72) Inventor: Yuji Ikeda, Kobe (JP)

(73) Assignee: IMAGINEERING, INC., Hyogo (JP)

( * ) Notice: Subject to any disclaimer, the term of this patent is extended or adjusted under 35 U.S.C. 154(b) by 33 days.

(21) Appl. No.: 14/156,170

(22) Filed: Jan. 15, 2014

(65) Prior Publication Data

US 2014/0190438 A1 Jul. 10, 2014

Related U.S. Application Data

(63) Continuation of application No. PCT/JP2012/068007, filed on Jul. 13, 2012.

(30) Foreign Application Priority Data

Jul. 16, 2011 (JP) ..... 2011-157285
Aug. 10, 2011 (JP) ..... 2011-175451

(51) Int. Cl.
*F02P 23/04* (2006.01)
*F02P 3/045* (2006.01)
(Continued)

(52) U.S. Cl.
CPC ..... *F02P 23/045* (2013.01); *F02P 3/01* (2013.01); *F02P 3/045* (2013.01); *F02P 9/007* (2013.01);
(Continued)

(58) Field of Classification Search
CPC ..... F02P 3/01; F02P 3/045; F02P 23/04; F02P 23/045; F02M 27/042
USPC ..... 123/146.5 R, 143 B, 145 R, 536
See application file for complete search history.

(56) References Cited

U.S. PATENT DOCUMENTS 8,186,322 B2 * 5/2012 Ikeda ..... 123/143 B
8,464,695 B2 * 6/2013 Ikeda ..... 123/539
(Continued)

FOREIGN PATENT DOCUMENTS

JP 2006-132518 A 5/2006
JP 2008-82286 A 4/2008
(Continued)

OTHER PUBLICATIONS

JP2009281188 A (Eiji Tanabe) Dec. 3, 2009 (machine translation). [online][retrieved on Jul. 10, 2015]. Retrieved from Espacenet.*
(Continued)

*Primary Examiner* — Mahmoud Gimie
(74) *Attorney, Agent, or Firm* — Westerman, Hattori, Daniels & Adrian, LLP

(57) ABSTRACT

The size of the plasma produced by a plasma-generating device that generates plasma using electromagnetic (EM) radiation is enlarged. The plasma-generating device has an EM-wave-generating device that generates EM radiation, a radiation antenna that emits the EM radiation supplied from the EM-wave-generating device to a target space, and a receiving antenna located near the radiation antenna. The receiving antenna is grounded such that an adjacent portion that is close to the radiation antenna has a higher voltage while the EM radiation is emitted from the radiation antenna. The plasma-generating device generates plasma in the target space near the radiation antenna and the adjacent portion by emitting EM radiation from the radiation antenna.

6 Claims, 6 Drawing Sheets

(51) Int. Cl.

| | |
|---|---|
| ***F02P 3/01*** | (2006.01) |
| ***F02P 9/00*** | (2006.01) |
| ***H05H 1/46*** | (2006.01) |
| ***H05H 1/52*** | (2006.01) |
| ***F02P 15/00*** | (2006.01) |
| *F02P 23/00* | (2006.01) |
| *F02M 27/04* | (2006.01) |

(52) U.S. Cl.
CPC ..... *F02P 15/00* (2013.01); *F02P 23/04* (2013.01); *H05H 1/46* (2013.01); *H05H 1/52* (2013.01); *F02M 27/042* (2013.01); *H05H 2001/463* (2013.01)

(56) References Cited

U.S. PATENT DOCUMENTS

2009/0229581 A1* 9/2009 Ikeda ..... 123/536
2009/0266325 A1* 10/2009 Kumar et al. ..... 123/143 B
2010/0187968 A1* 7/2010 Ikeda et al. ..... 313/134

FOREIGN PATENT DOCUMENTS

JP 2009281188 A * 12/2009
JP 2010-101174 A 5/2010
JP 2010101174 A * 5/2010
WO 2009/008520 A1 1/2009

OTHER PUBLICATIONS

International Search Report dated Nov. 13, 2012 issued in corresponding application No. PCT/JP2012/068007.

* cited by examiner

PLASMA GENERATING DEVICE AND INTERNAL COMBUSTION ENGINE

TECHNICAL FIELD

The present invention relates to a plasma-generating device that generates plasma using electromagnetic (EM) radiation, and an internal combustion engine that employs the plasma-generating device.

BACKGROUND

A plasma-generating device that generates plasma using EM radiation is known. For example, JP 2007-113570A1 discloses an ignition device including such a plasma-generating device.

An ignition device described in JP 2007-113570A1 is equipped in an internal combustion engine. The ignition device generates a plasma discharge by emitting microwaves in a combustion chamber before or after the ignition of an air-fuel mixture. The ignition device produces local plasma using the discharge from an ignition plug such that the plasma is generated in a high-pressure field, and then develops this plasma using the microwaves. The local plasma is generated in a discharge gap between the tip of an anode terminal and a ground terminal.

In a conventional internal combustion engine, plasma is produced near a radiation antenna that emits EM radiation.

SUMMARY OF INVENTION

The first invention relates to a plasma-generating device comprising an electromagnetic (EM) wave-generating device that generates EM radiation, a radiation antenna that emits the EM radiation supplied from the EM-wave-generating device to a target space, and a receiving antenna located near the radiation antenna. The receiving antenna is grounded such that an adjacent portion that is in close proximity to the radiation antenna has high voltage while the EM radiation is emitted from the radiation antenna. The plasma is generated near the radiation antenna and the adjacent portion.

The second invention relates to an internal combustion engine including an internal combustion engine body formed with a combustion chamber, and an EM-wave-emitting device that emits EM radiation to the combustion chamber from the radiation antenna. The combustion of an air-fuel mixture is enhanced by the EM radiation emitted to the combustion chamber. The internal combustion engine comprises a receiving antenna located near the radiation antenna, and the receiving antenna is grounded such that an adjacent portion that is close to the radiation antenna has higher voltage when the EM radiation is emitted from the radiation antenna. An intense electric field is generated near the radiation antenna and the adjacent portion in the combustion chamber by emitting the EM radiation from the radiation antenna during flame propagation in the combustion chamber.

DESCRIPTION OF THE PREFERRED EMBODIMENTS

The embodiments of the present invention are detailed with reference to the accompanying drawings. The embodiments below are the preferred embodiments of the present invention, but they are not intended to limit the scope of the invention or application or usage thereof.

The first embodiment relates to internal combustion engine 10 equipped with plasma-generating device 30 of the present invention. Internal combustion engine 10 is a reciprocating internal combustion engine where piston 23 reciprocates. Internal combustion engine 10 has internal combustion engine body 11, and plasma-generating device 30. In internal combustion engine 10, combustion cycles of ignition and combustion of the air-fuel mixture are repetitively executed exploiting plasma that is generated from plasma-generating device 30.

Internal Combustion Engine Body

Figure 1:
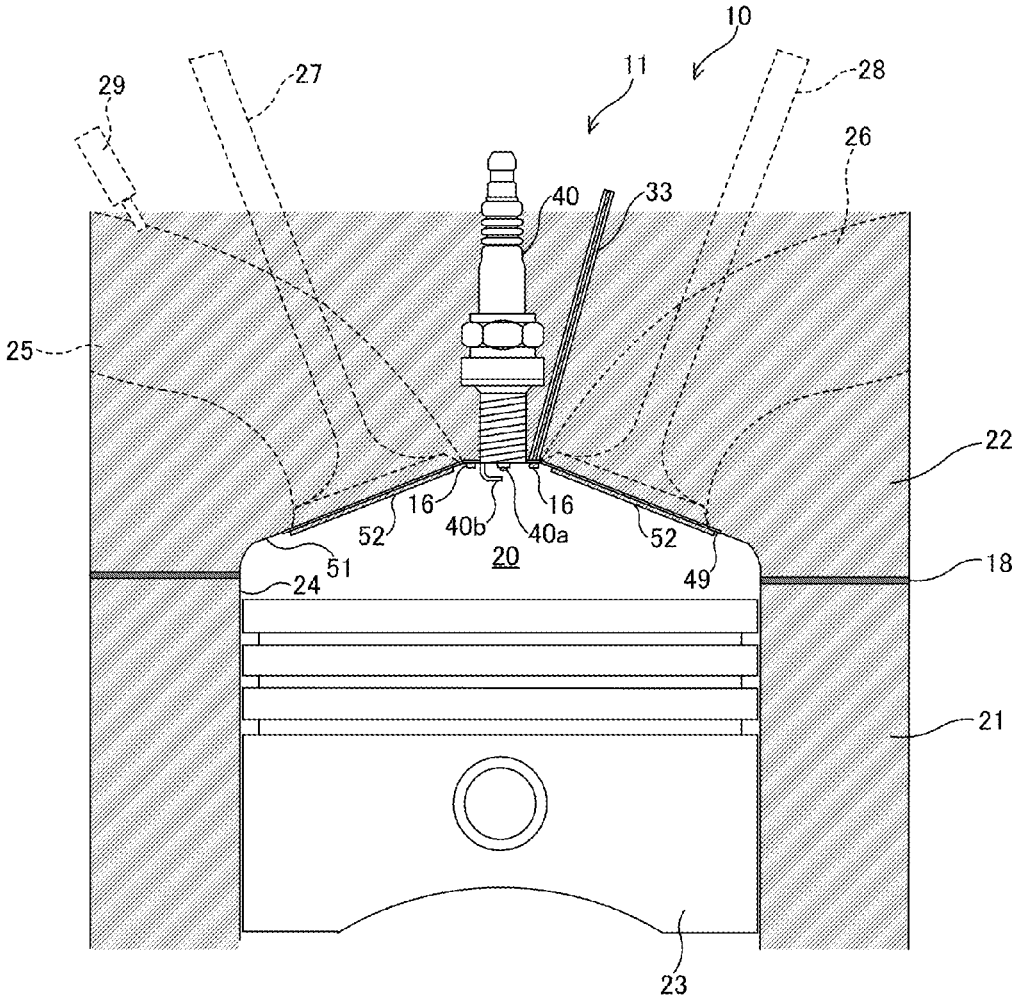
FIG. 1 shows a longitudinal sectional view of an internal combustion engine according to one embodiment.

As illustrated in FIG. 1, internal combustion engine body 11 has cylinder block 21, cylinder head 22, and piston 23. Multiple cylinders 24, each having a rounded cross-section, are formed in cylinder block 21. Reciprocating pistons 23 are located in each cylinder 24. Pistons 23 are connected to a crankshaft through a connecting rod (not shown in the figure). The rotatable crankshaft is supported on cylinder block 21. The connecting rod converts the reciprocations of pistons 23 to the rotation of the crankshaft when pistons 23 reciprocate inside each cylinder 24, in the axial direction of cylinders 24.

Cylinder head 22 is located on cylinder block 21 sandwiching gasket 18 in between. Cylinder head 22 forms circular-sectioned combustion chamber 20 together with cylinders 24, pistons 23, and gasket 18. The diameter of combustion chamber 20 is approximately half the wavelength of the microwave radiation emitted from EM-wave-emitting device 13, which will be discussed later.

A single ignition plug 40, which is a part of ignition device 12, is provided for each cylinder 24 of cylinder head 22. The front tip of ignition plug 40 that is exposed to combustion chamber 20 is located at the center part of the ceiling surface 51 of combustion chamber 20. Surface 51 is exposed to combustion chamber 20 of cylinder head 22. The outer-circumference of the front tip of ignition plug 40 is circular when viewed in the axial direction. Center electrode 40*a* and earth electrode 40*b* are formed on the tip of ignition plug 40. A discharge gap is formed between the tip of center electrode 40*a* and the tip of earth electrode 40*b*.

Inlet ports 25 and outlet ports 26 are formed for each cylinder 24 in cylinder head 22. Inlet port 25 has inlet valve 27 for opening and closing inlet port opening 25*a* of inlet port 25, and injector 29 for injecting fuel. Outlet port 26 has outlet valve 28 for opening and closing outlet port opening 26*a* of outlet port 26. In internal combustion engine body 11, inlet port 25 is designed so that an intense tumble flow is formed in combustion chamber 20.

Plasma-Generating Device

Figure 3:
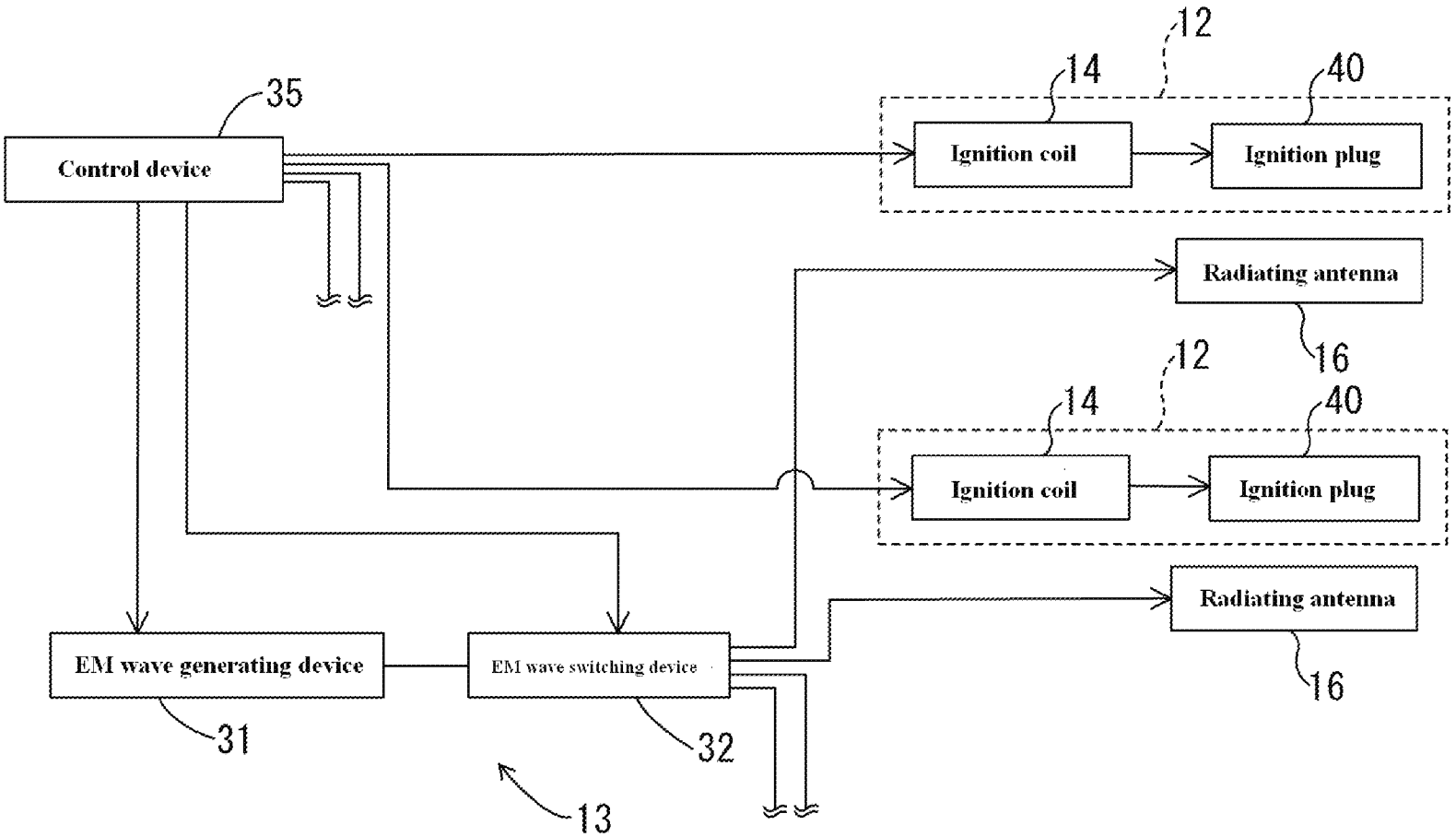
FIG. 3 shows a block diagram of a plasma-generating device according to one embodiment.

Plasma-generating device 30 has discharge device 12 and EM-wave-emitting device 13, as shown in FIG. 3.

Discharge devices 12 are provided for each combustion chamber 20. Each discharge device 12 has ignition coil 14 that outputs a high-voltage pulse, and ignition plug 40 to which the high-voltage pulse is supplied from ignition coil 14.

Ignition coil 14 is connected to a direct current (DC) power supply (not shown in the figure). Ignition coil 14 boosts the voltage applied from the DC power when an ignition signal is received from electronic control device 35, and then outputs the boosted high-voltage pulse to center electrode 40*a* of ignition plug 40. In ignition plug 40, dielectric breakdown occurs in the discharge gap when a high-voltage pulse is applied to center electrode 40*a*, whereupon a spark discharge occurs. The discharge plasma is generated by the spark discharge. A negative voltage is applied as the high-voltage pulse in center electrode 40*a*.

As illustrated in FIG. 3, EM-wave-emitting device 13 has EM-wave-generating device 31, EM-wave-switching device 32, and radiating antenna 16. One EM-wave-generating device 31 and EM-wave-switching device 32 are provided for each EM-wave-emitting device 13. Radiating antennas 16 are provided for each combustion chamber 20.

EM-wave-generating device 31 repeatedly outputs current pulses at a predetermined duty ratio when an EM-wave-driving signal is received from electronic control device 35. The EM-wave-driving signal is a pulsed signal. EM-wave-generating device 31 repeatedly outputs microwave pulses during the pulse-width time of the driving signal. In EM-wave-generating device 31, a semiconductor oscillator generates microwave pulses. Other oscillators, such as a magnetron, may also be used instead of the semiconductor oscillator.

EM-wave-switching device 32 has one input terminal and multiple output terminals provided for each radiation antenna 16. The input terminal is connected to EM-wave-generating device 31. Each output terminal is connected to the corresponding radiation antenna 16. EM-wave-switching device 32 is controlled by electronic control device 35 so that the destination of the microwaves outputted from the generating device 31 switches between radiation antennas 16.

Radiation antenna 16 is located on ceiling surface 51 of combustion chamber 20. Radiation antenna 16 is annular in form when viewed from the front side of ceiling surface 51 of combustion chamber 20, and surrounds the tip of ignition plug 40. Radiation antenna 16 may also be C-shaped when viewed from the front side of ceiling surface 51.

Radiation antenna 16 is laminated on annular insulating layer 19 formed around an installation hole for ignition plug 40 on ceiling surface 51 of combustion chamber 20. Insulating layer 19 may be formed by spraying an insulator, for example. Radiation antenna 16 is electrically insulated from cylinder head 22 by insulating layer 19. The perimeter of radiation antenna 16, i.e., the perimeter of the centerline between the inner-circumference and the outer-circumference, is set to half the wavelength of microwaves emitted from radiation antenna 16. Radiation antenna 16 is electrically connected to the output terminal of EM-wave-switching device 32 through microwave transmission line 33 buried in cylinder head 22.

In this embodiment, receiving antennas 52 are installed between neighboring inlet port openings 25*a* and outlet port openings 26*a*. Four receiving antennas 52 are provided. Each receiving antenna 52 is a straight rod-shaped conductor. Each receiving antenna 52 extends in the radial direction of cylinder 24. Four receiving antennas 52 are arranged outside of radiation antenna 16 in a radial fashion.

Each receiving antenna 52 is located on rectangular insulating layer 49 formed on a ceiling surface 51 of combustion chamber 20. Each receiving antenna 52 is electrically insulated from cylinder head 22 by insulating layer 49.

The inner edge of each receiving antenna 52 is located close to radiation antenna 16, and the outer edge of each antenna 52 is grounded through grounding circuit 53. The distance between each receiving antenna 52 and radiation antenna 16, i.e., the minimum distance between the inner edge of each receiving antenna 52 and outer-circumference of radiation antenna 16, is less than or equal to ⅛ of the wavelength of the microwave radiation. Thus, when the microwaves are emitted from radiation antenna 16, the induced current flows in each receiving antenna 52 due to the electric field formed near radiation antenna 16.

Grounding circuit 53 connects each receiving antenna 52 to grounded cylinder head 22. The distance L between the inner edges of each receiving antenna 52 and a grounding point of grounding circuit 53 satisfies Eq. 1, where N is an integer of 0 or more and λ is the wavelength of the microwaves emitted from radiation antenna 16.

$$L=(2n+1)\times(\lambda/4) \quad \text{Eq 1:}$$

In each receiving antenna 52, the inner edge becomes an anti-node of the voltage wave originating from the induced current during the microwave-emitting period, when microwave pulses are repetitively emitted from radiation antenna 16, i.e., the microwave-emitting period corresponding to one EM-wave-driving signal. Each receiving antenna 52 is grounded so that the voltage of the adjacent portion, which is close to radiation antenna 16, becomes higher compared to other portions.

Receiving antenna 52 is an antenna having a fixed end at the outer side and a free end at the inner side. This is because this antenna is grounded only at the outside. Therefore, this antenna resonates with the frequency of the microwave radiation when the length is an integer number of quarter wavelengths of the microwave radiation. With such an antenna, the receiving sensitivity is increased.

When the receiving sensitivity is increased, the electric field tends to concentrate near receiving antenna 52. Thus, the region of the plasma generated near radiation antenna 16 can expand toward receiving antenna 52.

Figure 2:
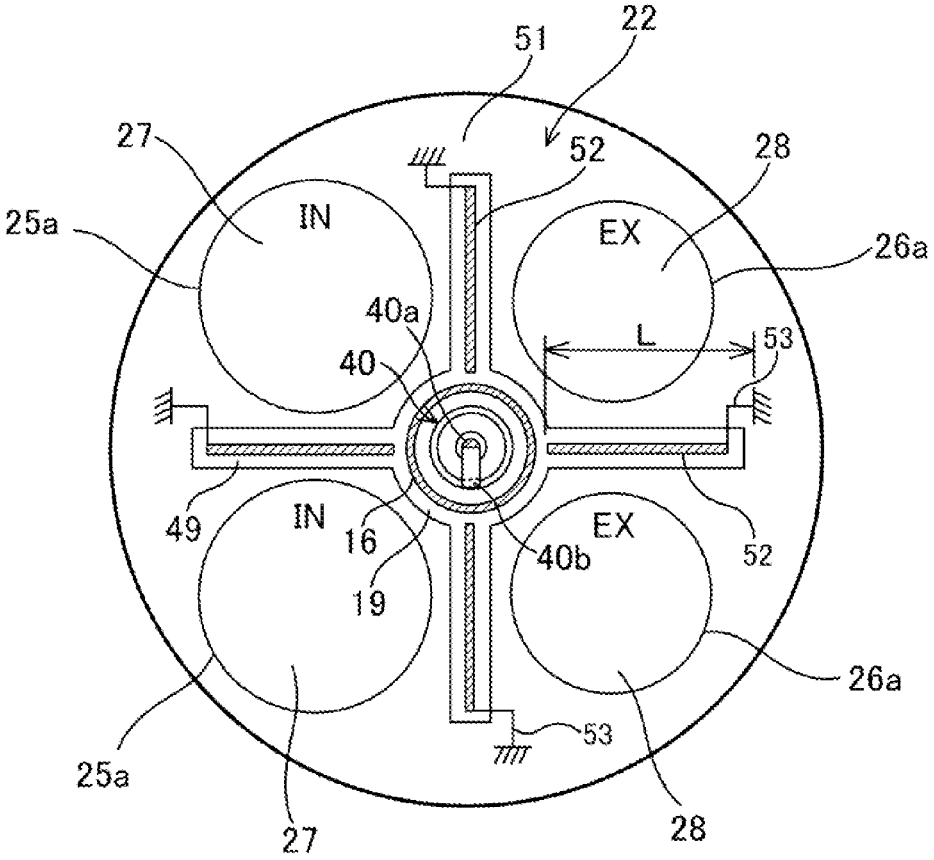
FIG. 2 shows a front view of a ceiling surface of the combustion chamber of the internal combustion engine according to one embodiment.

The receiving antenna may be designed such that both ends become the fixed ends or both ends become the free ends. In such a case, the antenna resonates with the frequency of the microwave radiation when the length of the antenna $L_2$ is an integer number of half wavelengths of the microwave radiation. It follows that the length of the antenna should be twice that of receiving antenna 52. Accordingly, it is advantageous to ground only one end (the outer end), as shown in FIG. 2, in order to reduce the length of the antenna.

When the frequency of the microwave radiation emitted from the radiating antenna is 2.5 GHz, the wavelength λ [m], which can be calculated by dividing the speed of light ($3\times10^8$) by $2.5\times10^9$, is approximately equal to 12 cm. Thus, it is desirable to set the length of receiving antenna 52 to approximately 3 cm. Assuming that the diameter of cylinder 23 is approximately 10 cm, it is possible to install receiving antenna 52 in the radial direction.

Plasma-Generation Process

The plasma-generation process of plasma-generating device 30 will be described.

In internal combustion engine 10, ignition, whereby the air-fuel mixture is ignited by microwave plasma generated by plasma-generating device 30, occurs immediately prior to piston 23 reaching top dead center (TDC). During ignition, electronic control device 35 outputs an ignition signal and an EM-wave-driving signal simultaneously.

In discharge device 12, the high-voltage pluses originate from ignition coil 14, which receives the ignition signal. The high-voltage pulses are then applied to center electrode 40*a* of ignition plug 40. The spark discharge occurs in the discharge gap of ignition plug 40, and discharge plasma is produced.

In EM-wave-emitting device 13, EM-wave-generating device 31 repeatedly outputs pulses of microwave radiation during the pulse-width of the driving signal when an EM-wave-driving signal is received. The microwave pulses are emitted repeatedly from radiating antenna 16. In combustion chamber 20, an intense electric field is formed near radiation antenna 16.

In each receiving antenna 52, the induced current flows during the period whereby microwave radiation is emitted, as described above. In each receiving antenna 52, the distance L from the inner edge to the grounding point should satisfy Eq. 1. Thus, the inner edge of receiving antenna 52 becomes an anti-node of the standing wave and has a high potential during the microwave radiation period. The intense electric field near radiation antenna 16 expands toward the adjacent portion of receiving antenna 52 in combustion chamber 20.

In combustion chamber 20, electrons of the discharge plasma are accelerated by the intense electric field. The accelerated free electrons collide with ambient molecules, which become ionized. The free electrons generated by this ionization are also accelerated by the electric field, and subsequently ionize the ambient molecules. The ionization process forms an avalanche. As a result, the discharge plasma expands and the microwave-induced plasma is produced in the intense electric field. The microwave-induced plasma generated near radiation antenna 16 expands toward the adjacent portions of receiving antenna 52. The plasma region becomes larger compared with the case where receiving antenna 52 is not installed.

In this embodiment, the microwave radiation period is set to cover the spark discharge period. The spark discharge may occur while the intense electric field is generated by the microwave radiation.

The air-fuel mixture is ignited by the microwave plasma in combustion chamber 20. The flame expands outside toward the wall of cylinder 24 from the ignition position where the air-fuel mixture is ignited.

EM-wave-emitting device 13 may repetitively output pulses of microwave radiation from radiation antenna 16 to combustion chamber 20 following the ignition of the air-fuel mixture. The microwave pulses are repeatedly emitted during flame propagation near radiation antenna 16. In combustion chamber 20, an intense electric field is formed near radiation antenna 16 and the adjacent portion in each receiving antenna 52 while the flame propagates close to the location of radiation antenna 16. The propagation speed of the flame increases due to microwave radiation when the flame passes the intense electric field.

When the amount of energy in the microwave radiation is large, plasma is generated in the intense electric field. In the region of the plasma, activated species, such as OH-radicals, are produced. The propagation speed of the flame is increased by the presence of the activated species.

Advantage of the Embodiment

In the present embodiment, the region of the plasma is enlarged by receiving antenna 52, which expands the intense electric field near radiation antenna 16. The average temperature in the plasma region decreases when the size of the plasma region increases. This inhibits the rapid loss of the generated activated species. Therefore, the propagation speed of the flame is efficiently increased by the activated species generated by the microwave plasma.

Modification 1

Figure 4:
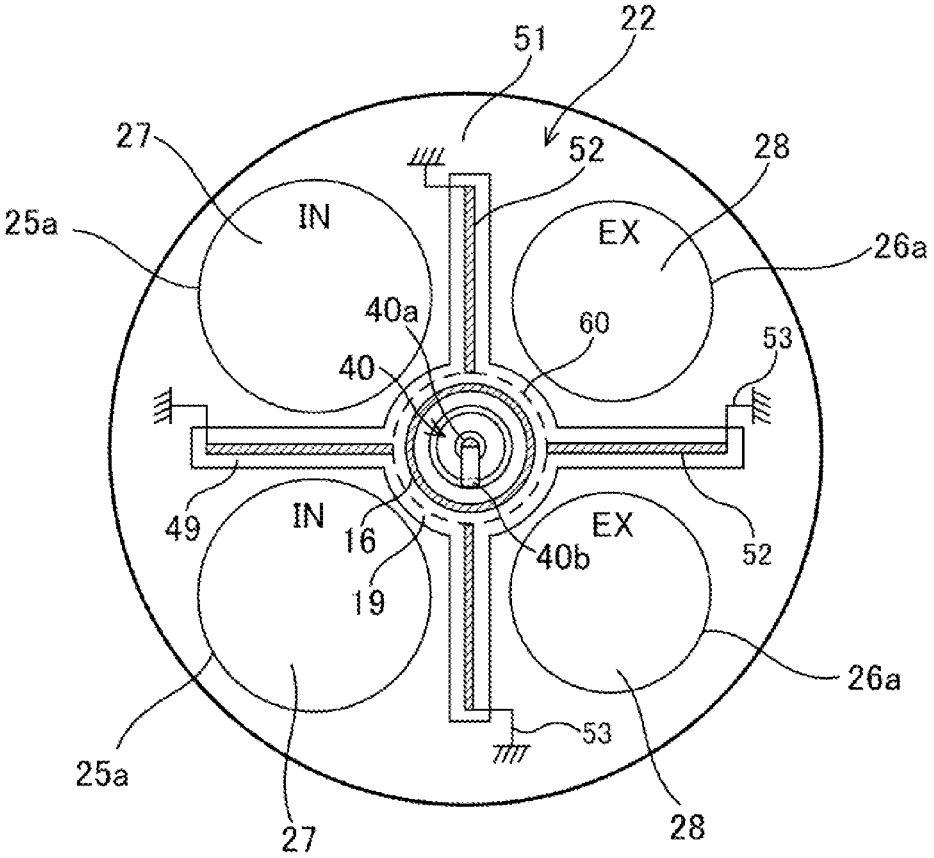
FIG. 4 shows a front view of a ceiling surface of the combustion chamber of the internal combustion engine according to modification 1.

In the first modification, connecting conductor 60 (a pressure equalizing conductor) that electrically connects the adjacent portions in multiple receiving antennas 52 installed in cylinder head 22. As shown in FIG. 4, the inner edges of four receiving antennas 52 are electrically connected to each other by connecting conductor 60, which is annular in form. The amplitude of the electrical potential at inner edges of each receiving antenna 52 is equalized in this modification. Thus, the size of the plasma regions at the inner edges of the four receiving antennas 52 may be equalized.

Modification 2

In the second modification, center electrode 40*a* of ignition plug 40 may also function as a radiation antenna. A mixing circuit that can mix the high-voltage pulses and the microwave signals is connected to center electrode 40*a* of ignition plug 40. The mixing circuit receives the high-voltage pulses from ignition coil 14 and the microwave signal from EM-wave-switching device 32 using separate input terminals, and then outputs the high-voltage pulses and the microwave signal from the same output terminal.

Figure 5:
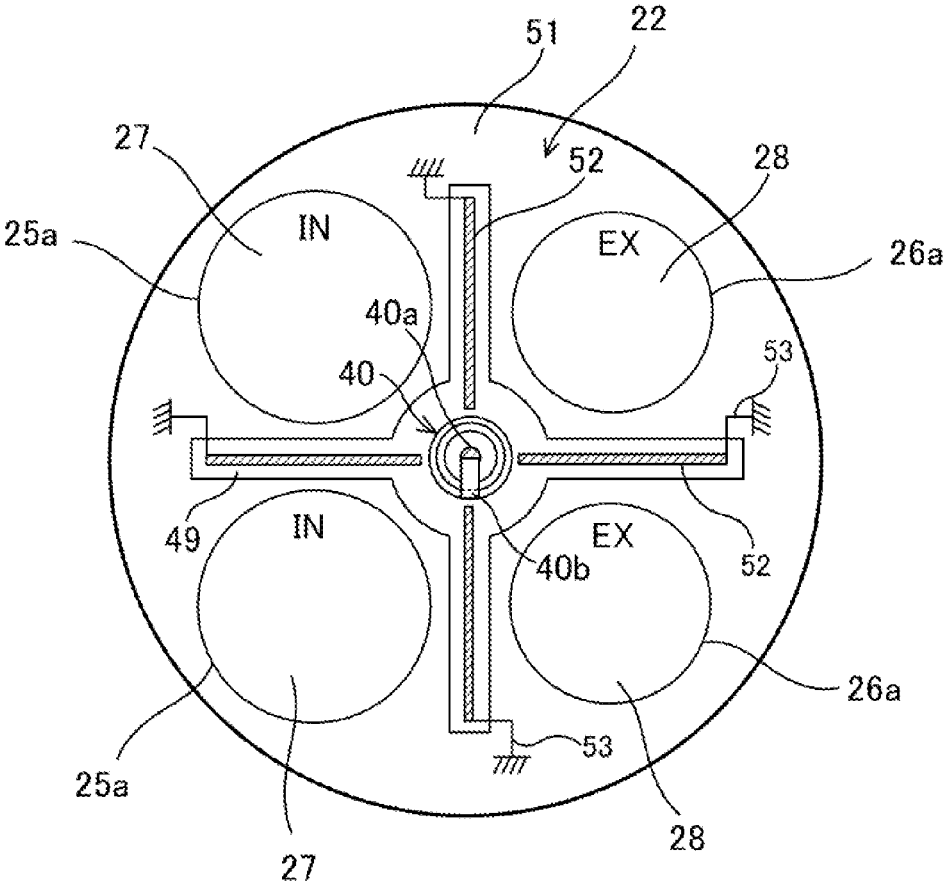
FIG. 5 shows a front view of a ceiling surface of the combustion chamber of the internal combustion engine according to modification 2.

The inner edge of each receiving antenna 52 is located adjacent to ignition plug 40, as shown in FIG. 5. The distance between the inner edge of each receiving antenna 52 and the outer circumference of center electrode 40*a* is equal to or less than ⅛ of the microwave radiation emitted from center electrode 40*a*.

In this modification, the microwave radiation is emitted from center electrode 40*a* following the ignition of the air-fuel mixture. An intense electric field is then formed near center electrode 40*a*, and the induced current flows in each receiving antenna 52. The inner edge of each receiving antenna 52 becomes the anti-node of a standing wave, and the electrical potential becomes high throughout the microwave radiation period. As a result, the plasma induced near center electrode 40*a* expands to the adjacent portions in each receiving antenna 52. The microwave plasma may be generated during the ignition operation as well as in the previous embodiment.

Modification 3

Figure 6:
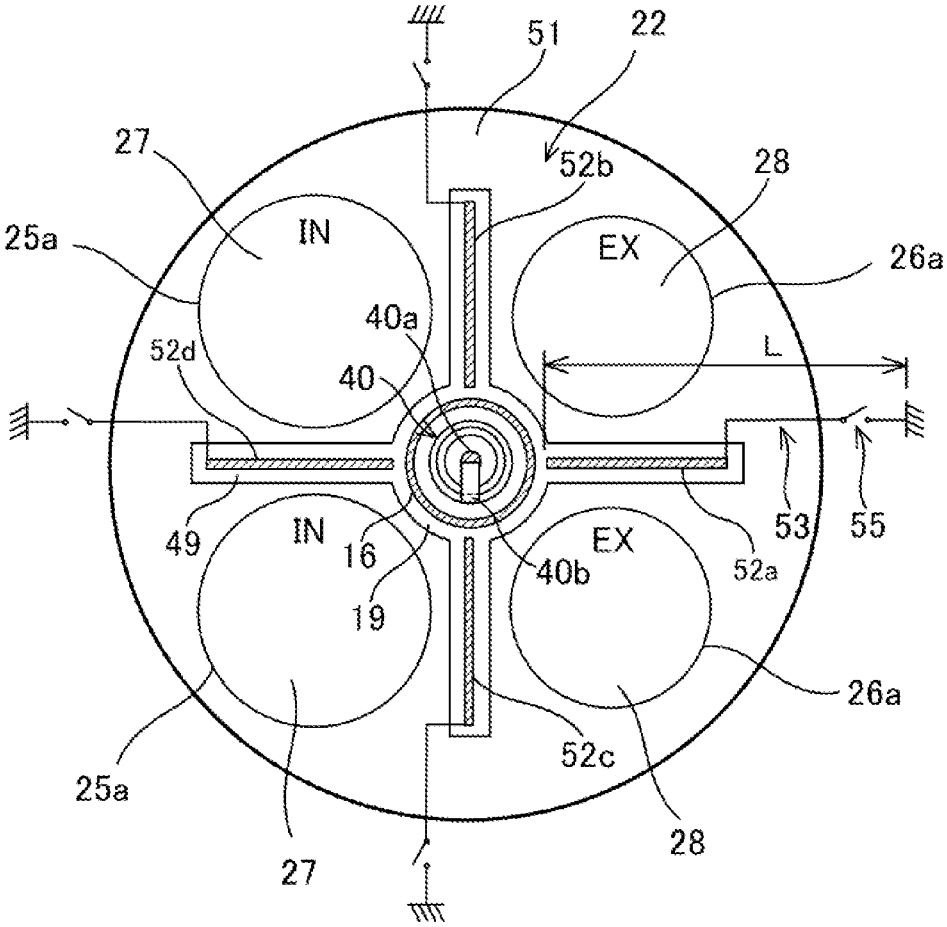
FIG. 6 shows a front view of a ceiling surface of the combustion chamber of the internal combustion engine according to modification 3.

In the third modification, switching element 55 is provided on grounding circuit 53 of each receiving antenna 52, as shown in FIG. 6. Switching element 55 of each grounding circuit 53 is turned on or off by electronic control device 35.

Each switching element 55 corresponding to each of four receiving antennas 52 is turned on sequentially during the microwave radiation period following the ignition of the air-fuel mixture. When one switch element is turned on, the rest of switching elements 55 are turned off.

For example, when the ignition position of the air-fuel mixture shifts from the center of ignition plug 40 to the exhaust side due to the tumble flow, the flame first passes the inner edge of first receiving antenna 52*a*, which is between exhaust-side openings 26*a*. The flame then passes the inner edges of second receiving antenna 52*b* or third receiving antenna 52*c* that are between exhaust-side opening 26*a* and intake-side opening 25*a*. The flame finally passes the inner edge of fourth receiving antenna 52*d*, which is between intake side openings 25*a*. Electronic control device 35 activates switching elements 55, which correspond to antennas 52*a*, 52*b*, 52*c*, and 52*d* in sequence. Switching elements 55 for antennas 52*b* and 52*c* may be activated simultaneously or in a sequence opposite to that described above.

In this modification, the voltage at each receiving antenna 52 may be controlled by applying a reverse bias voltage instead of grounding each receiving antenna 52*a* to 52*d* using switching elements 55.

Other Embodiments

The following embodiments may be contemplated.

In the above embodiment, radiation antenna 16 may be covered with an insulator or a dielectric material. Receiving antenna 52 may also be covered with an insulator or a dielectric material.

In the above embodiment, the plasma is generated by discharge device 12 for producing microwave-induced plasma during the ignition operation. The plasma may be produced using microwave radiation only and without generating the discharge plasma.

In the above embodiment, the microwave-induced plasma is produced using microwave radiation only and without generating the discharge plasma following the ignition of the air-fuel mixture. The discharge plasma may also be produced by discharge device 12 as well as in the ignition operation, and the microwave-induced plasma may be produced using this discharge plasma.

INDUSTRIAL APPLICABILITY

As described above, the present invention is useful for a plasma-generating device that generates plasma using EM radiation, and an internal combustion engine that is equipped with the plasma-generating device.

The invention claimed is:

1. A plasma-generating device comprising:

an electromagnetic (EM)-wave-generating device that generates EM radiation, a radiation antenna that emits the EM radiation supplied from the EM-wave-generating device to a target space, and a receiving antenna located near the radiation antenna, whereby the receiving antenna is grounded such that an adjacent portion close to the radiation antenna has a high voltage while the EM radiation is emitted from the radiation antenna, wherein the plasma is generated near the radiation antenna and the adjacent portion, the radiation antenna is annular or C-shaped in form, the plasma-generating device includes a plurality of receiving antennas, and each receiving antenna is rod-shaped in form and extends in a direction away from the radiating antenna at the outer side of the radiating antenna from said adjacent portion.

2. The plasma-generating device as claimed in claim 1 further comprising:

a connecting conductor, which electrically connects the adjacent portions in the plurality of receiving antennas.

3. The plasma-generating device as claimed in claim 1, wherein each receiving antenna is grounded by a grounding circuit such that the adjacent portion has a higher voltage while the EM radiation is emitted from the radiation antenna, and a switching element is provided on the grounding circuits of each of the receiving antennas.

4. The plasma-generating device as claimed in claim 3, wherein the plurality of receiving antennas are grounded in sequence by controlling the switching element.

5. The plasma-generating device as claimed in claim 1, further comprising:

a discharge device that generates a discharge in the target space while or before the period that the EM radiation is emitted from the radiation antenna.

6. An internal combustion engine comprising:

the plasma-generating device as claimed in claim 1, and an internal combustion engine body equipped with an ignition plug at a center portion of the combustion chamber, wherein the radiation antenna is located on the ceiling surface of the combustion chamber so as to surround the ignition plug, and the plurality of receiving antennas are located in a radial fashion outside the radiation antenna.

* * * * *